United States Patent [19]

Lukas et al.

[11] Patent Number: 4,531,724

[45] Date of Patent: Jul. 30, 1985

[54] METHOD AND APPARATUS FOR CONTROLLING SHEETS IN A HOPPER

[75] Inventors: David C. Lukas, Neshanic, N.J.; James R. Moser; James R. Schlough, both of Easton, Pa.

[73] Assignee: Stobb, Inc., Clinton, N.J.

[21] Appl. No.: 569,295

[22] Filed: Jan. 9, 1984

[51] Int. Cl.[3] ..... B65H 1/06; B65H 3/08

[52] U.S. Cl. ..... 271/166; 271/101

[58] Field of Search ..... 271/166, 101, 134, 99, 271/100, 102, 104, 106, 3.1, 4

[56] References Cited

U.S. PATENT DOCUMENTS

| | | | |
|---|---|---|---|
| 3,008,706 | 12/1961 | Heigl et al. | 271/101 X |
| 3,527,367 | 9/1970 | Bivans | 414/330 |
| 3,650,525 | 3/1972 | Hageman et al. | 271/101 |
| 4,093,209 | 6/1978 | Greenwell et al. | 271/3.1 |

FOREIGN PATENT DOCUMENTS

| | | | |
|---|---|---|---|
| 2230230 | 2/1973 | Fed. Rep. of Germany | 271/166 |
| 2038783 | 7/1980 | United Kingdom | 271/166 |

OTHER PUBLICATIONS

Beran, M. A. et al., "Recirculating Feed Stack Position Indicator", IBM Technical Disclosure Bulletin, vol. 23, No. 9, Feb. 1981, p. 4021.

*Primary Examiner*—Bruce H. Stoner, Jr.
*Assistant Examiner*—Lawrence J. Goffney, Jr.
*Attorney, Agent, or Firm*—Arthur J. Hansmann

[57] ABSTRACT

Method and apparatus for controlling sheets in a hopper, whereby the stack of sheets is partially supported at various elevations along the stack so that only a portion of the weight of the stack bears downwardly on the sheet removal devices. The stack support members are movable into and out of supporting position relative to the stack, by virtue of a solenoid or the like, for passing a discrete lower portion of the stack down to the take-off device, and a feeler is provided for sensing the need for passing more sheets downwardly, in accordance with the rate of removing the sheets from the bottom of the stack.

20 Claims, 3 Drawing Figures

METHOD AND APPARATUS FOR CONTROLLING SHEETS IN A HOPPER

This invention relates to a method and apparatus for controlling sheets in a hopper, and, more particularly, it relates to the support of the sheets in the hopper so that they can be removed one-by-one.

BACKGROUND OF THE INVENTION

The graphic arts industry commonly employs systems for removing sheets or signatures separately from a stack of signatures, such as in the process of gathering or collating the removed signatures. In that well-known function, the bottom one of a stack of sheets or signatures is taken from the stack while the rest of the stack remains in position, with the bottom sheet or signature being removed from the stack, one-by-one. In that process, it is common practice, and commonly preferred, that the stack be in at least a reclining position where the weight of the stack bears downwardly on the bottom signature. Therefore, the removal of the bottom signature or sheet is impaired, because of the weight of the stack on it.

To facilitate the removal of the sheet, the prior art has resorted to devices for somewhat supporting the stack while the sheet is removed, and one such device is a commonly employed rotating disk which slides between the bottom sheet and the remainder of the stack while the bottom sheet is moved below the rotating disk. Other types of supports for the entire stack are sometimes utilized, such as that shown in U.S. Pat. No. 3,527,367 where a stop and a clamp are disclosed for controlling the stack.

In the instance where the prior art utilizes the rotating disk mentioned, there are inherent problems, such as the concern about the disk sliding over the bottom of the stack and thereby distorting and marring the bottom signature or sheet. The rotating disk can move the bottom sheet out of registration or alignment, and thus the handling of that sheet or signature is impaired. Further, each time that the rotating disk sweeps underneath the pile or stack, the stack bounces and this creates control problems and undesirable vibrations.

The present invention improves upon the prior art in that it provides both a method and apparatus for controlling the stack of sheets or signatures in a tray or hopper, and the control is such that the entire weight of the stack does not bear downwardly toward the bottom sheet or signature which is to be removed. In that respect, the bottom sheet is not damaged in removal and is not moved out of line, since the bottom sheet is in a freer state for removal, since the entire weight of the stack does not bear downwardly on the bottom sheet. In this regard, there is an escapement device which presents only a limited number of sheets to the removal process or apparatus, and thus the improved control is achieved in this invention, compared to the prior art.

Still further, the present invention improves upon the prior art in that it provides both a method and apparatus which can be readily incorporated in the prior art existing apparatus of a hopper with a rotating disk and a suction member or the like for removing the bottom sheet. It will of course be understood that the graphic arts industry already has a considerable number of stack hoppers and removal devices already in existence. The present invention is completely suitable for incorporation into the existing devices, with a minimum of material and with no appreciable revision or reconstruction of any of the existing apparatus.

The present concept or invention is for allowing a discrete quantity of sheets or signatures to be fed downwardly in a hopper in a controlled manner while relieving the weight of the remainder of the stack or pile from that sheet separating area, all so that the bottom sheet or signature can be removed with only a minimum of resistance thereon.

DETAILED DESCRIPTION OF THE APPARATUS AND METHOD

Figure 1:
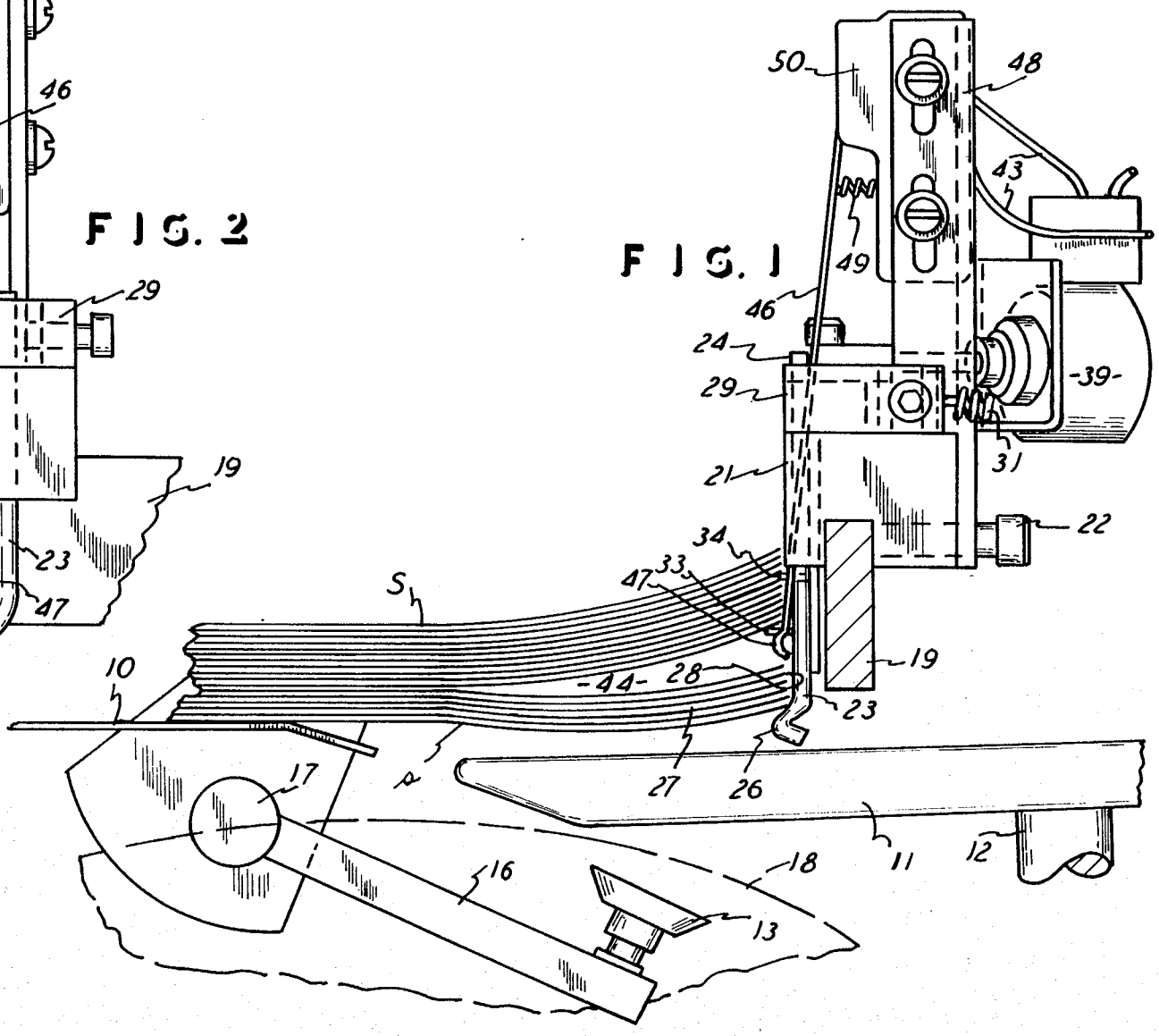
FIG. 1 is a side-elevational view of one embodiment of this invention.
Figure 3:
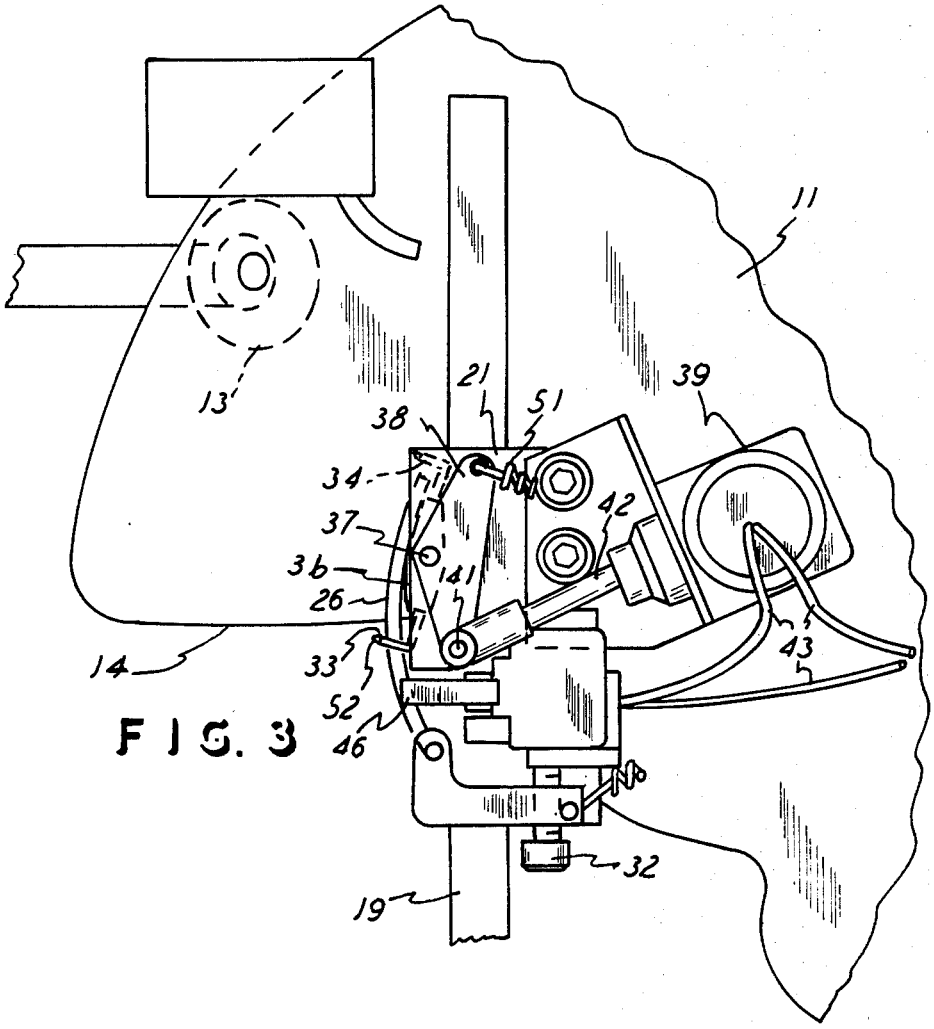
FIG. 3 is a top plan view of a portion of FIG. 1.

In describing the apparatus shown in the drawings, the method invention will also be disclosed. FIG. 1 shows a stack of sheets or signatures s supported in a tray or hopper 10. The conventional sweeping or rotating disk 11 is shown mounted on its shaft 12 to project underneath the stack S and be synchronized with the conventional pick-up device or sucker 13. Thus, the rotating conventional disk 11 is shown in FIG. 3 to have its usual cut-out portion designated 14 which permits the sucker 13 to move upwardly, from its FIG. 1 position, and contact the lowermost signature or sheet s when the opening 14 is directly below the stack S. Of course the sucker 13 is in the form of a vacuum cup, and is mounted on a pivot arm 16 extending off a shaft 17. Thus, in the usual arrangement, the sucker or cup 13 pivots up-and-down to contact the lowermost sheet or signature s and pull it down below the plane of the disk 11 which then sweeps between the lowermost sheet s and the remainder of the stack S, and the sucker 13 continues to move the lowermost sheet s down onto the conventional gripper cylinder 18 which is shown in dot-dash lines. In that manner, the signatures or sheets are removed, one-by-one, from the bottom of the stack S. That is conventional and the method and apparatus mentioned is well understood by anyone skilled in the art.

The problem with the arrangement, to the point described, is that the entire stack S has its weight downward and is thus essentially bearing down on the disk 11, in the prior art arrangement. In the present invention, means and method are provided so that the entire stack S does not bear downwardly and thus does not force down onto the rotating disk 11.

To accomplish that, an escapement device is provided for permitting only a discrete or selected quantity of signatures or sheets in the bottom of the stack S to fall downwardly toward the disk 11 and, even then, only a single sheet is presented to the disk 11. The remainder of the drawings show the apparatus of this invention which is mounted on a frame piece 19, for instance, and, as such, this apparatus can be readily fitted to existing hoppers and removal members of the prior art, such as those already mentioned.

A mounting block 21 is suitably attached to the frame piece 19, such as by a screw 22. The block 21 supports the various elements of the apparatus of this invention, including a pile support rod 23 which has a vertically extending shank 24 extending through the block 21 and therebelow in a curved lower portion 26 which provides an upward support for the discrete portion 27 of the entire stack S, as shown in FIG. 1. The drawings further show that the lower support 26 is curved and thus extends directly below the leading edges 28 of the sheets or signatures in the stack, to upwardly support those edges 28 and thus support the pile 27, as shown. Of course the cup 13 will move upwardly to the lower one of the sheets in the pile 27 and thus pull it downwardly, by vacuum or suction, to below the plane of the rotating disk 11 which then separates the lower sheet from the remainder of the stack while the unshown gripper on the gripper cylinder 18 pulls that lower sheet out and away from the entire stack S.

At this time it will also be mentioned that the rod 23 is secured in a rod support member 29 on top of the block 21, and a tension spring 31 is attached to the member 29 to yieldingly urge the support rod 23 toward the sheet edges 28. The spring 31 is and can be adjustable so that the amount of spring urging of the rod 23 is controllable. In that manner, the discrete or small pile 27 is held upwardly by the rod 23, and then the bottom sheet of the pile 27 is removed when the sucker 13 pulls that sheet below the rod portion 26. An adjustment screw 32 extends through the member 29 and abutts to provide a control for the amount that the spring 31 can urge upon the sheets while permitting the rod 28 to move away from the sheets. That is, circumstances might cause the rod to be pushed away from the pile completely, and the free signatures will then rest on the disk 11, but shortly the rod 23 will find its way back toward the pile, and the amount of spring tension and the setting of the screw 32 can determine this to suit the particular stiffness and weight of sheet or signature being handled.

Figure 2:
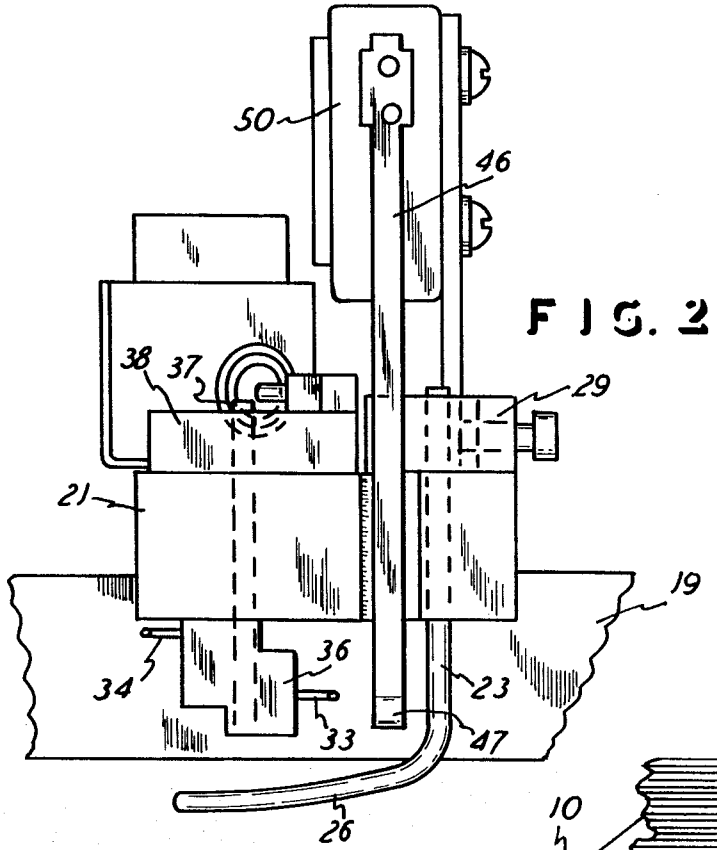
FIG. 2 is a front-elevational view of a portion of FIG. 1.

Two pile support members, in the form of pins 33 and 34, are suitably attached to a block 36 which in turn is attached to a vertical rod 37 extending through the block 21, all as shown in FIG. 2. A rocker member 38 is affixed to the upper end of the rod 37 and pivots about the vertical axis of the rod 37 through the influence from an electric solenoid 39 connected thereto at a pin 41. Thus, the solenoid plunger 42 extends from the solenoid 39 which is electrically connected through the wires 43. The rocker 38 rocks in a relatively small angle, say 20 degrees or so, to alternately present the pins 33 and 34 to the sheet stack S, such as shown in FIG. 1 with the lowermost pin 33 projecting into the stack S and thus permitting the formation of the gap 44 in the stack. Therefore, when one pin 33 or 34 is projected into the stack at the edge thereof adjacent the upright portion 24 of the support rod 23, then the other pin 33 or 34 is clear of the stack S and the sheets can move therebeyond. That is, from the position shown in the drawings, particularly in FIG. 3, the rocker 38 can be moved in a counter-clockwise direction to withdraw the pin 33 while inserting the pin 34 relative to the stack S. Of course the pins 33 and 34 are shown to be at two different elevations.

A probe or feeler 46 is also mounted on the block 21 and extends downwardly along the forward edge of the stack S and terminates in a lower end 47 which is shown in FIG. 1 to be projecting into the stack gap 44. The probe 46 is movable toward and away from the stack S, and it has the offset end 47 for sensing the existence of the gap 44, and, when the stack sheets above the probe end 47 move downwardly, then the end 47 is moved to the right, as viewed in FIG. 1, and the entire probe 46 thus moves to actuate an electric switch 50 in the upper structure such as at 48, and that unshown switch is connected with the solenoid, such as through the wires 43, all in a conventional manner for connecting a trip switch with a solenoid or the like.

A compression spring 49 is shown to extend between the feeler 46 and the upper body housing 48, to urge the probe or feeler 46 to the left, as viewed in FIG. 1, and thus toward the stack S. The arrangement is such that when the stack S falls downwardly against the probe end 47, the probe 46 moves to the right, as viewed in FIG. 1, and thus actuates the switch 50 which in turn controls the solenoid 39 to pull its rod 42 inwardly and thereby counter-clockwise pivot the block 38 for the withdrawal of the pin 33 and the simultaneous insertion of the pin 34, both relative to the stack S.

The function is such that the sucker 13 pulls the bottom sheet downwardly, and the disk 11 separates that sheet from the remainder of the stack while that separated sheet is placed onto the gripper cylinder 18 and carried away. The stack portion 27 is retained upwardly by the pile support rod 23, and, upon further removal of sheets from the pile, the gap 44 is formed in the pile, and the probe 47 moves into the gap 44 or senses the gap to activate the solenoid 39 which therefore pivots the block 38 and withdraws the support or pin 33 while simultaneously inserting the pin or support 34, thus allowing another portion of the stack to fall downwardly to the level of the support rod end 26. Also, in that process, the probe end 47 is pushed to the right, and thus the solenoid is deactivated, and a tension spring 51, connected to the pivot block 38, causes the pivot block to pivot back to its original position where the pin 33 is projected into the stack while the pin 34 is retracted, all as shown in FIG. 1 and FIG. 3. In a fast cycling of the pivot of the block 38, it is conceivable only one support or pin 33 or the like is required so that it can be withdrawn and reinserted after that short time interval a discrete number of the sheets fall below the withdrawn single pin 33. The basic feature is to allow a discrete quantity of sheets or signatures to fall or be fed downwardly in the hopper in a controlled manner, and thereby relieve the weight of the entire pile acting in the separating area.

In describing the apparatus, the method has also been described, and it will be seen and understood that various portions of the stack are supported by various support members at different elevations along the front edge of the stack, all so that the entire weight of the stack is not bearing downwardly on the take-off devices and the separating disks or the like. Thus there is a control means operative with the support elements, shown to be in the nature of the pins 33 and 34, and there is the sensor, in the form of the probe 46, connected with the control means, for the structure and method mentioned herein. Further, the pins 33 and 34 are needle shaped with pointed ends 52 extending toward the stack for clean and sharp insertion into the stack.

What is claimed is:

1. A method of controlling sheets in a hopper containing a stack of sheets which are at least generally horizontally disposed and are to be singly removed from the bottom of the stack, the steps comprising releasably upwardly supporting a first portion of the stack at one edge in an initial position of the lowermost one of the sheets, releasably upwardly supporting a second portion of the stack with a movable support extending into the stack at one edge of a sheet above said lowermost one of the sheets and at one elevation in the stack, singly withdrawing sheets from the bottom of the stack and thereby form a gap in the stack between said two portions and along the plane between said edges, sensing said gap and thereupon withdrawing said support from the stack and allowing some sheets to drop toward said intial position, and reinserting said support into the stack and upwardly supporting that portion of the stack above said support after said some sheets have dropped.

2. The method of controlling sheets in a hopper, as claimed in claim 1, wherein said sensing is electrical and said support is electrically controlled and electrically related to said sensing.

3. The method of controlling sheets in a hopper, as claimed in claim 2, wherein said sensing includes positioning a movable probe on said plane for movement of said probe into said gap.

4. The method of controlling sheets in a hopper, as claimed in claim 1, including the step of yieldingly urging a member toward the stack at said lowermost one of the sheets for the upwardly supporting of the said first portion of the stack.

5. The method of controlling sheets in a hopper, as claimed in claim 1, including the step of yieldingly urging a probe toward the stack at said gap for movement of said probe into said gap.

6. The method of controlling sheets in a hopper, as claimed in claim 1, including the step of additionally releasably upwardly supporting a third portion of the stack at an elevation above said one elevation and with another movable support moved into the stack when the first said support is withdrawn from the stack, and subsequently withdrawing said another movable support from the stack when said first support is extended into the stack.

7. Apparatus for controlling sheets in a hopper containing a stack of sheets which are at least generally horizontally disposed and are to be singly removed from the bottom of the stack, comprising a first support member for releasably upwardly supporting a first portion of the stack at one edge in an initial position of the lowermost one of the sheets, a movable second support member extendable into the stack at one edge of a sheet above said lowermost one of the sheets and at one elevation on the stack for releasably upwardly supporting a second portion of the stack, means for singly removing the sheets from said first portion at the bottom of the stack and thereby create a gap in the stack between said two portions and along the plane between said edges, control means operatively connected with said second support for moving said second support into and out of the stack and a sensor disposed relative to said supports for sensing said gap and being operatively connected with said second support member for movement of said second support member out of the stack upon the sensing of said gap, and thereby have sheets in said second portion fall below said one elevation to be supported by said first support member, and for movement of said second support member into the stack.

8. The apparatus for controlling sheets in a hopper, as claimed in claim 7, wherein said sensor is an electric sensor having a probe extending into said gap.

9. The apparatus for controlling sheets in a hopper, as claimed in claim 7, wherein said first support member is yieldingly urged toward the stack for upwardly supporting the first portion of the stack.

10. The apparatus for controlling sheets in a hopper, as claimed in claim 7, wherein said sensor includes a probe extendable into said gap and being yieldingly urged toward the stack for sensing the gap.

11. The apparatus for controlling sheets in a hopper, as claimed in claim 7, including a movable third support member extendable into the stack at one edge of a sheet above said one elevation for releasably upwardly supporting a third portion of the stack, said second and third support members being interconnected, and said control means being operatively connected to said second and third support members for the mutually exclusive movement of said second and third support members into and out of the stack.

12. The apparatus for controlling sheets in a hopper, as claimed in claim 11, wherein said second and said third support members are needle shaped for moving into the stack.

13. The apparatus for controlling sheets in a hopper, as claimed in claim 7, wherein said second support member includes a portion which initially penetrates the stack when moving into the stack, and with said portion being narrower at its edge which first moves into the stack compared to the remainder of said portion.

14. Apparatus for holding sheets in a stack of sheets which are lying flat and with the sheets to be removed singly from the bottom of the stack, comprising first means for singly removing the sheets from the stack, support means disposed above said first means for moving into the stack, for holding the sheets away from said first means and developing a gap in the stack, and for moving out of the stack, for allowing the sheets to drop toward said first means, and sensing means operatively connected with said support means for sensing said gap and accordingly moving said support means out of the stack and subsequently moving said support means into the stack.

15. The apparatus for holding sheets in a stack of sheets which are lying flat and with the sheets to be removed singly from the bottom of the stack, as claimed in claim 14, including an additional support means disposed higher than the elevation of the first said support means and being operatively connected with said sensing means for moving into and out of the stack alternately with the first said support means.

16. The apparatus for holding sheets in a stack of sheets which are lying flat and with the sheets to be removed singly from the bottom of the stack, as claimed in claim 14, including control means operatively connected with said support means and said sensing means for moving said support means in response to the sensing of said sensing means.

17. The apparatus for holding sheets in a stack of sheets which are lying flat and with the sheets to be removed singly from the bottom of the stack, as claimed in claim 16, including an additional support means disposed higher than the elevation of the first said support means and being operatively connected with said sensing means for moving into and out of the stack alternately with the first said support means.

18. The apparatus for holding sheets in a stack of sheets which are lying flat and with the sheets to be removed singly from the bottom of the stack, as claimed in claim 14, including an additional support means disposed lower than the elevation of the first said support means for supporting the portion of the stack which is below the first said support means.

19. The apparatus for holding sheets in a stack of sheets which are lying flat and with the sheets to be removed singly from the bottom of the stack, as claimed in claim 18, including an additional support means disposed higher than the elevation of the first said support means and being operatively connected with said sensing means for moving into and out of the stack alternately with the first said support means.

20. The apparatus for holding sheets in a stack of sheets which are lying flat and with the sheets to be removed singly from the bottom of the stack, as claimed in claim 14, wherein said sensing means includes a probe extendable into said gap and being yieldingly urged toward the stack for sensing the gap.

* * * * *